US005380376A

United States Patent [19]

Fortin et al.

[11] Patent Number: 5,380,376

[45] Date of Patent: Jan. 10, 1995

[54] ALUMINUM ALLOY FOR ARMOURED CABLE WRAP

[75] Inventors: Paul E. Fortin; Pierre-Henri Marois, both of Kingston, Canada

[73] Assignee: Alcan International Limited, Montreal, Canada

[21] Appl. No.: 71,299

[22] Filed: Jun. 2, 1993

[51] Int. Cl.[6] ..... C22C 21/06

[52] U.S. Cl. ..... 148/440; 148/439; 174/102 A; 174/108; 420/533; 420/542; 420/543; 420/545; 420/553

[58] Field of Search ..... 420/533, 542, 543, 545, 420/553; 148/551, 552, 688, 692, 439, 440; 174/102 A, 108

[56] References Cited

U.S. PATENT DOCUMENTS

| | | | |
|---|---|---|---|
| 2,003,297 | 6/1935 | Keller et al. | 420/533 |
| 3,961,944 | 6/1976 | Yanagida et al. | 420/528 |
| 5,104,465 | 4/1992 | McAuliffe et al. | 148/439 |
| 5,106,429 | 4/1992 | McAuliffe et al. | 148/439 |
| 5,110,545 | 5/1992 | McAuliffe et al. | 420/534 |
| 5,181,969 | 1/1993 | Komatsubara et al. | 420/543 |

*Primary Examiner*—Richard O. Dean
*Assistant Examiner*—Robert R. Koehler
*Attorney, Agent, or Firm*—Cooper & Dunham

[57] ABSTRACT

An improved aluminum alloy armoured cable wrap has been produced which permits the use of less aluminum alloy in the cable wrap thereby achieving lighter construction, while meeting or exceeding strength and flexibility requirements. The armoured cable wrap is made from aluminum alloy strip material formed of an aluminum alloy containing about 2.8–3.5 percent by weight Mg, about 0.25-0.70 percent by weight Mn and about 0.15–0.35 percent by weight Cr. Up to 0.5 percent by weight of Cu may also be added. The strip material is heat treated preferably to an Ultimate Tensile Strength of at least 265 MPa.

20 Claims, No Drawings

ALUMINUM ALLOY FOR ARMOURED CABLE WRAP

BACKGROUND OF THE INVENTION

This invention relates to improvements in aluminum alloy for use in armoured cable wrap which permits the use of less aluminum alloy in the cable wrap, achieving lighter construction whilst still meeting cable strength requirements. It also relates to an alloy strip for use in making the cable wrap and to the armoured cable wrap formed from the strip.

Metal armoured electrical cables have been known for many years in which an electrical conduit is contained within a metal wrap or sheath. This armour wrap is typically formed from steel or aluminum alloys with a thin strip of metal being formed into a spiral with an overlap between each turn or convolution of the strip. When formed into a wrap, the metal strip typically takes on an "S" curve shape in cross-section with varying wall thickness. The metal strips used for this purpose are supplied in a number of different sizes depending upon the diameter of the cable. Typical thicknesses and widths respectively are (a) 0.025 inches×0.375 inches (b) 0.034 inches×0.5 inches (c) 0.04 inches×0.75 inches and (d) 0.06 inches×1.0 inch. The flexibility of the cable or a particular design is typically governed by the number of turns per unit length of armour wrap, and Underwriters Laboratories, for example, specify a minimum of 43 turns per foot of length for the 0.025 inches×0.375 inches (0.64 mm×9.5 mm) strip.

In addition to meeting flexibility requirements, armoured cable wrap must meet various strength standards, for example crush resistance, but more particularly with regard to tension or pull-out. Of course, there is at the same time always the desire to achieve as light a construction as possible.

In attempting to produce lightweight cable through use of aluminum alloys, cable manufacturers have attempted to reduce the amount of material required in the cable wrap by using designs with as few turns per unit length as possible and as thin a wall section as possible. However, they have been limited by the requirements of strength standards. Typically, in order to meet strength standards, manufacturers are required to produce armour electrical cable (for wrap produced from 0.025×0.375 inch strip) meeting Underwriters Laboratories minimum pull test requirements of 300 pounds (at 100% pass rate). For aluminum alloy armour wrap, this requires as many as 49 to 50 turns/foot and a finished wall thickness of 0.02 to 0.025 inches (0.5 to 0.6 mm) to pass. As an alternative, steel can be used for producing the armour wrap, which allows the strength requirements to be met, but with a penalty on weight.

In order to produce aluminum alloy cable wrap with minimum material requirements, it is necessary to be able to reduce the number of turns per foot of armour wrap down close to the minimum of 43 turns/foot permitted by regulations for 0.025×0.375 inch strip and to be able to use a minimum thickness wall construction. However, current aluminum alloy materials do not permit this. In order to form an armour wrap, a high degree of formability is needed to make the narrow radius bends that are required and such formability is not found in available aluminum alloys accompanied by the high strength needed to assure that the strength tests can be met.

Typical alloys that have been used for this purpose include Aluminum Association designated alloys: AA3004 (nom. 1.2% Mn, 1.0% Mg), AA5052 (nom. 2.5% Mg, 0.25% Cr), AA5154 (nom. 3.5% Mg, 0.25% Cr). Other alloys have been proposed. For example Yanagida et al, U.S. Pat. No. 3,961,944, issued Jun. 8, 1976 discloses an alloy containing less than 1.7% Mn and less than 0.8% Cr with optional Li intended for use in armour wrap with low eddy current characteristics while retaining high formability.

It is, therefore, the purpose of the present invention to provide an aluminum alloy material which can be used to produce lightweight armour cable wrap which meets or exceeds the requirements of Underwriters Laboratories (UL) tests for strength.

SUMMARY OF THE INVENTION

According to the present invention, it has been determined that aluminum alloys can be developed with a particular combination of alloying elements meeting the above minimum material requirements together with the formability and strength requirements. Thus, the aluminum alloy of the present invention for use as armoured cable wrap is one containing (by weight) 2.8–3.5% Mg, 0.25–0.70% Mn, 0.15–0.35% Cr and optionally up to 0.5% Cu. Although many alloys are known which contain Mg, Mn, Cr and Cu, the use of the ratios stated above provides the specific properties required for use in armour cable wrap. Whilst strength can be increased by addition of any of the above alloying elements and principally Mg and Mn, addition of Mg must be limited to prevent work hardening which would result in armour wrap with poor formability. Similarly, excessive Mn will impair formability. Use of Cu has some beneficial effects, but excessive amounts result in lowered recrystallization temperatures and a variation in mechanical properties with annealing temperature which is unacceptably high for commercial use. Therefore, the Cu is considered optional in this alloy. The Cr has a significant beneficial effect in ensuring a high recrystallization temperature and therefore ensures good property stability for commercial use. The particular combination of the alloying elements therefore ensures the formability required for processing into armour cable wrap along with strength required to pass UL strength tests, and the stability of properties under commercially useful processing conditions.

A particularly preferred aluminum alloy according to this invention is one containing 2.8–3.2% Mg, 0.32–0.42% Mn, 0.18–0.28% Cr and up to 0.1% Cu. The aluminum is preferably commercial purity aluminum (with the usual impurities) and the aluminum may be grain refined using Ti alone or together with B.

The aluminum alloy can be prepared by any known commercial method and can be conveniently cast and formed by well-known methods. For instance, a billet (sometimes referred to as a wire bar) can be semi-continuously (or direct chill) cast, then hot rolled to rod or strip and subsequently cold rolled to final strip dimensions. Alternatively an extrusion billet can be semi-continuously cast then extruded to rod or strip and subsequently cold rolled to final strip dimensions. Frequently, a continuous casting, hot rolling process (for example, Properzi or Secim casting) is used to produce rod which is subsequently cold rolled to final strip dimensions. After an alloy strip has been formed to final thickness, it is typically heat treated to produce the desired formability. For example, heat treatments at between 200 and 300° C. for at least one hour may be used, but preferably the conditions are adjusted to meet a minimum strength requirement of at least 265 MPa Ultimate Tensile Strength (UTS) and preferably 285 to 315 MPa UTS. This latter condition corresponds to an H24 temper for the preferred alloy range.

As mentioned above, the aluminum strip may be produced in various thicknesses and widths. A common size is 0.025 inches thick by 0.375 inches (0.64 mm×9.5 mm). The strip may be formed into armour cable wrap on most armour cable wrapping machines, for example BX Armouring Machine. Many other continuous interlock armour machines can also be used, such as machines manufactured by Ceeco Machinery Mfg. Ltd. of Concord, Ontario; Cancab Technologies Ltd. of Mississauga, Ontario and Cabletrade of Concord, Ontario. When a 0.025 inches×0.375 inches strip of the composition of this invention which has been subjected to the heat treatment disclosed, is used in the above cable wrapping equipment, cable having no more than 50 turns per foot and even less than 45 turns per foot can be produced. Such a wrap has been found to have a full strength under UL tests of at least 300 pounds at a 100% pass rate.

EXAMPLES

The invention will now be explained in greater detail by reference to the following non-limiting examples. Unless otherwise indicated, all parts, percentages, ratios and the like are by weight.

Example 1

A series of tests were conducted to compare various physical properties of the alloys of the present invention with aluminum alloy AA5052, which is the alloy normally used for armoured cable wrap. Book mould castings were made of various alloys. Compositions are identified in Table 1. Alloys A, B and AA5052 lie outside the range of this invention. Alloys C and E lie inside the range and alloy D lies inside the range except for the absence of Cr.

TABLE 1

| Alloy | Mg | Mn | Cr | Cu |
|---|---|---|---|---|
| AA5052 | 2.51 | <.001 | .19 | <.002 |
| A | 2.53 | .37 | .23 | .002 |
| B | 2.48 | .37 | .23 | .31 |
| C | 2.98 | .69 | .23 | <.002 |
| D | 3.53 | .37 | <.005 | .31 |
| E | 3.44 | .37 | .21 | .30 |

Following casting, the samples were rolled while still hot, the cold rolled to strip and annealed at various temperatures in the range 225° to 300° C., to simulate as closely as possible the continuous casting/rolling/heat treating procedure normally followed in making armour cable wrap materials. Longitudinal tensile properties were measured and are shown in Table 2 for the various test alloys and for AA5052 prepared in the same manner.

TABLE 2

| Alloy | Ultimate Tensile Strength (MPa) | | | | | Yield Strength (MPa) | | | | |
|---|---|---|---|---|---|---|---|---|---|---|
| Heat Treat. Temp. | As rolled | 225° C. | 250° C. | 275° C. | 300° C. | As rolled | 225° C. | 250° C. | 275° C. | 300° C. |
| AA5052 | 347 | 280 | 268 | 255 | 229 | 342 | 246 | 228 | 205 | 157 |
| A | 374 | 314 | 301 | 292 | 287 | 369 | 286 | 266 | 249 | 240 |
| B | 408 | 336 | 322 | 306 | 300 | 404 | 308 | 286 | 264 | 252 |
| C | 414 | 358 | 344 | 336 | 330 | 408 | 328 | 306 | 290 | 278 |
| D | 460 | 357 | 337 | 271 | 265 | 452 | 308 | 275 | 150 | 143 |
| E | 471 | 379 | 361 | 350 | 344 | 464 | 338 | 311 | 294 | 284 |

For samples and tests done under controlled conditions as in this example, the yield strength is considered to be the most useful tensile property (as opposed to larger scale and commercial practice where Ultimate Tensile Strength may be more practical). For purposes of these tests, a target yield strength of 317 MPa was selected. This was a strength such that armour wrap of any design made from a material of this strength would be expected to pass Underwriters Laboratories pull tests. In addition, it matched tensile properties of steel based materials frequently used for this application.

Based on Table 2, Alloys B through E could meet this requirement under the normal range of heat treatment conditions. However, Alloy D (no Cr) shows a rapid loss of YS with temperature which is undesirable for alloys for commercial use and this consequently demonstrates the need for Cr in the alloy of this invention.

The YS of 317 MPa could be used to interpolate within Table 2 to determine the exact heat treatment conditions required to obtain this YS. For some alloys (A, B and AA5052) the interpolation is somewhat imprecise since the heat-treatment temperature equivalent to the as-rolled condition is not well defined. For purposes of this example a value of 70±20° C. was selected.

Formability tests (Erichsen cup heights and minimum bend radii—longitudinal and transverse) were conducted for the same alloys and over the same heat treatment conditions. Using the interpolated heat treatment temperatures corresponding to a YS of 317 MPa, the formability results were interpolated for each alloy corresponding to a yield strength of 317 MPa. These results are shown in Table 3.

TABLE 3

| Alloy | Anneal[1] Temp (°C.) | R/t (L)[2] | R/t (L)[3] | Erichsen[4] |
|---|---|---|---|---|
| AA5052 | 110 ± 15[5] | 1.70 | 1.91 | .123 |
| A | 167 ± 8[5] | 1.65 | 1.44 | .144 |
| B | 211 ± 2[5] | 2.08 | 1.61 | .173 |
| C | 238 | 1.50 | 1.13 | .164 |
| D | 213 | 1.75 | 1.18 | .148 |
| E | 244 | 1.49 | 1.06 | .161 |

[1]Annealing temperature (°C.) for 317 MPa yield strength as interpolated from Table 2.
[2]Bend test ratio for sample taken in longitudinal direction and bent transversely.
[3]Bend test ratio for sample taken in transverse direction and bent longitudinally.
[4]Erichsen cup height in inches.
[5]For AA5052 and alloy A and B, annealing temperatures for YS 317 MPa required extrapolation below minimum test annealing temperature condition. It was assumed that "as-rolled" condition was approximately equal to 70 ± 20° C. annealing temperature for this extrapolation.

For good performance as an armour wrap material, alloys of equal YS, in this case 317 MPa, should have low values of bend test ratio as this is the best measure of the required formability for this application. High values of Erichsen cup height are also useful but not as critical for armour cable wrap applications.

It is clear that the samples C, D and E show superior formability at the required strengths. Addition of both Mg and Mn over the standard AA5052 is beneficial. Copper also shows beneficial results, but the benefit can be equalled by Mn and Mg additions, making it a useful but optional alloying element. Chromium appears in these examples to be also optional for formability but as noted above is essential to ensure that tensile (and other) properties are stable under the usual range of annealing temperature variation experienced in commercial practice.

Consequently, only the samples C and E, lying within the range of composition of this invention meet all the requirements of armour cable wrap materials.

Example 2

An aluminum alloy of composition 3.0% Mg, 0.37% Mn, 0.23% Cr and 0.05% Cu based on commercial purity aluminum was cast using a commercial Properzi casting method and continuously hot rolled to rod. The rod was then cold rolled to a strip of nominal thickness 0.026 inches (0.66 mm) by 0.375 inches (9.5 mm) wide and annealed at temperatures between 240 and 300° C. for periods of 4 hours at temperature, these conditions being selected in order to achieve an Ultimate Tensile Strength of 312 MPa. The UTS was selected as a more appropriate control parameter than yield strength for large scale production of material. An armour cable wrap was formed having approximately 43–45 turns per foot of length using a conventional cable forming machine. Such a machine deforms the original strip to an approximate "S" shape of variable thickness. Whilst subject to some measurement uncertainty, the thickness of the "S" shaped material at the arc of the "S" corresponding to a minimum OD in the finished cable was selected for comparative measurements. For armour cable formed in the above way, based on the alloy of this invention a wall thickness of 0.025 inches (0.63 mm) was obtained. This armour cable wrap was then subjected to standard Underwriters Laboratories pull tests (ANSI/UL4 - 1986).

As a control, an armoured cable wrap was prepared using similar equipment from conventional AA5052 alloy and subjected to the same pull tests. The results obtained are shown in Table 4 below:

TABLE 4

| | AA5052 control | Alloy of invention |
|---|---|---|
| Avr. Pass Weight (Lbs) | 260 | 375 |
| Range of Pass Weight (Lbs) | 240–315 | 330–430 |

To meet UL specifications, the product must meet a minimum pull requirement of 300 lbs at 100% pass rate. The alloy of this invention easily meets this requirement whereas the control (the usual alloy) does not.

Example 3

The pull-out strength of armour wrap produced from the alloy of this invention, as described in Example 2 was compared with various other known aluminum alloy wrap materials which are commercially available (S1 to S4). The characteristics of the different wrap materials and the results obtained are shown in Table 5 below:

TABLE 5

| | Alloy | Turns/ ft | OD (mm) | ID (mm) | Wall Thick (mm) | Pull Out (Lbs) as per UL4 |
|---|---|---|---|---|---|---|
| Alloy of Example 2 | | 43–45 | 12.5 | 7.8 | .63 | 375 |
| S1 | AA5052 | 49 | 13.4 | 9.7 | .54 | 312 |
| S2 | AA5052 | 50.5 | 13.2 | 8.6 | .40 | 175 |
| S3 | AA3104 | 46.5 | 14.1 | 10.1 | .59 | 290 |
| S4 | AA3104 | 46 | 14.6 | 9.6 | .57 | 282 |

As noted in Example 2, the measurement of wall thickness is imprecise. However, the samples based on the alloy of Example 2, S1, S3 and S4 are of similar dimensions with the sample S2 being significantly thinner wall. Based on these results it can be seen that armour cable wrap made with the alloy of this invention (Alloy of Example 2) has a pull out strength greater than typical commercial armour wraps. It achieves this improvement with fewer turns per foot, and therefore can be made as a lighter weight construction.

What is claimed is:

1. An armoured cable wrap having improved pull out strength consisting essentially of an alloy of aluminum, about 2.8–3.5 percent by weight Mg, about 0.25–0.70 percent by weight Mn and about 0.15–0.35 percent by weight Cr, wherein said alloy has been partially annealed to an ultimate tensile strength of at least 265 MPa prior to forming said wrap.

2. An armoured cable wrap as claimed in claim 1 wherein the aluminum is commercial purity aluminum.

3. An armoured cable wrap as claimed in claim 2 wherein the aluminum is grain refined using Ti alone or together with B.

4. An armoured cable wrap as claimed in claim 1 which also contains up to 0.5 percent by weight Cu.

5. An armoured cable wrap as claimed in claim 1 containing 2.8–3.2% Mg, 0.32–0.42% Mn, 0.18–0.28% Cr and up to 0.1% Cu.

6. An armoured cable wrap as claimed in claim 1 which has been heat treated at a temperature between 200° and 300° C. for at least one hour.

7. An armoured cable wrap as claimed in claim 1 which has been partially annealed to a UTS of between 285 and 315 MPa.

8. An aluminum alloy strip material suitable for use in the manufacture of armoured cable wrap having improved pull out strength, said strip material having a thickness of up to 0.060 inches (1.52 mm), a width of up to 1 inch (25.4 mm) and being formed of an aluminum alloy consisting essentially aluminum, about 2.8–3.5 percent by weight Mg, about 0.25–0.70 percent by weight Mn and about 0.15–0.35 percent by weight Cr, wherein said strip material has been partially annealed to an ultimate tensile strength of at least 265 MPa before being used in the manufacture of the armoured cable wrap.

9. A strip material as claimed in claim 8 which also contains up to 0.5 percent by weight Cu.

10. A strip material as claimed in claim 8 which has been partially annealed to a UTS of between 285 and 315 MPa.

11. A strip material as claimed in claim 10 which has been continuously cast and hot rolled to rod, then cold rolled to strip and heat treated.

12. A strip material as claimed in claim 8 having a width of about 0.375 inches (9.5 mm) and a thickness of about 0.025 inches (0.64 mm).

13. An armoured cable wrap having improved pull out strength comprising a spiral wrap formed of an aluminum alloy strip material consisting essentially of aluminum, about 2.8–3.5 percent by weight Mg, about 0.25–0.70 percent by weight Mn and about 0.15–0.35 percent by weight Cr, wherein said strip material has been partially annealed to an ultimate tensile strength of at least 265 MPa prior to forming the wrap.

14. An armoured cable wrap as claimed in claim 13 which also contains up to 0.5 percent by weight Cu.

15. An armoured cable wrap as claimed in claim 14 which has been heat treated at a temperature between 200° and 300° C. for at least one hour.

16. An armoured cable wrap as claimed in claim 13 which has been partially annealed to a UTS of between 285 and 315 MPa.

17. An armoured cable wrap as claimed in claim 13 formed from strip material having a width of about 0.375 inches (9.5 mm) and a thickness of about 0.025 inches (0.64 mm).

18. An armoured cable wrap as claimed in claim 17 having no more than 50 turns/foot of length.

19. An armoured cable wrap as claimed in claim 18 having no more than 45 turns/foot of length.

20. An armoured cable wrap as claimed in claim 19 having a pull strength of at least 300 pounds (136 kg) at 100% pass rate.

* * * * *